US006772474B2

(12) United States Patent
Nishikori et al.

(10) Patent No.: US 6,772,474 B2
(45) Date of Patent: Aug. 10, 2004

(54) UPRIGHT VACUUM CLEANER WITH SPRING LOADED NOZZLE

(75) Inventors: Tamaki Nishikori, Kusatsu (JP); Ron Davis, Danville, KY (US)

(73) Assignee: Matsushita Electric Corporation of America, Secaucus, NJ (US)

( * ) Notice: Subject to any disclaimer, the term of this patent is extended or adjusted under 35 U.S.C. 154(b) by 324 days.

(21) Appl. No.: 10/090,656

(22) Filed: Mar. 5, 2002

(65) Prior Publication Data

US 2002/0124344 A1 Sep. 12, 2002

Related U.S. Application Data

(60) Provisional application No. 60/275,065, filed on Mar. 12, 2001.

(51) Int. Cl.[7] ..... A47L 9/02
(52) U.S. Cl. ..... 15/359; 15/351
(58) Field of Search ..... 15/351, 352, 354, 15/359

(56) References Cited

U.S. PATENT DOCUMENTS 2,103,101 A 12/1937 Taylor
2,583,054 A * 1/1952 Kirby ..... 15/319
2,632,915 A 3/1953 Gerber
2,677,850 A 5/1954 Brace
3,163,439 A 12/1964 Huston et al.
3,217,351 A 11/1965 Hayba
3,262,147 A 7/1966 Waters et al.
3,772,727 A 11/1973 Worwag
3,827,103 A * 8/1974 Nordeen et al. ..... 15/359
4,014,068 A * 3/1977 Payne et al. ..... 15/355
4,446,594 A 5/1984 Watanabe et al.
5,080,525 A 1/1992 Bricher et al.
5,467,502 A 11/1995 Johnson et al.
5,819,370 A * 10/1998 Stein ..... 15/359
5,970,576 A 10/1999 Maurer et al.
5,985,156 A 11/1999 Henkin et al.
6,591,447 B2 * 7/2003 Wegelin et al. ..... 15/359

* cited by examiner

*Primary Examiner*—Terrence R. Till
(74) *Attorney, Agent, or Firm*—King & Schickli, PLLC

(57) ABSTRACT

An upright vacuum cleaner includes a nozzle assembly, a canister assembly pivotally mounted to said nozzle assembly, a suction fan and drive motor and a biaser. The biaser has a first end that engages the nozzle assembly and a second end that engages the canister assembly. The biaser provides a positive downforce urging the forward end of the nozzle assembly toward the surface being cleaned.

24 Claims, 4 Drawing Sheets

20
10
18
32
22
12
16
46
46
35
34
14
30
38a
36
38b

UPRIGHT VACUUM CLEANER WITH SPRING LOADED NOZZLE

This application claims the benefit of U.S. Provisional Patent Application No. 60/275,065, filed Mar. 12, 2001.

TECHNICAL FIELD

The present invention relates generally to the vacuum cleaner art and, more particularly, to an upright vacuum cleaner incorporating a spring loaded nozzle.

BACKGROUND OF THE INVENTION

Upright vacuum cleaners in all of their designs and permutations have become increasingly popular over the years. The upright vacuum cleaners generally incorporate a nozzle assembly and a canister assembly pivotally mounted to the nozzle assembly. Wheels on the nozzle and canister assemblies allow the vacuum cleaner to smoothly ride over the surface to be cleaned.

The canister assembly includes an operating handle that is manipulated by the user to move the vacuum cleaner back-and-forth across the floor. The canister assembly also includes either a bag-like filter or a cyclonic separation chamber and filter combination that trap dirt and debris while substantially clean air is exhausted by a fan that is driven by an onboard electric motor. It is this fan and motor arrangement that generates the drop in air pressure necessary to provide the desired cleaning action.

In most upright vacuum cleaners sold today, a rotary agitator is also provided in the nozzle assembly. The rotary agitator includes tufts of bristles, brushes, beater bars or the like to beat dirt and debris from the nap of a carpet being cleaned while the pressure drop or vacuum is used to force air entrained with this dirt and debris into the nozzle of the vacuum cleaner.

As the vacuum cleaner is manipulated back-and-forth by the operator with the handle on the canister assembly, the nozzle assembly is periodically lifted slightly from the floor. This lifting action adversely affects the cleaning efficiency of the vacuum cleaner. Further, during the cleaning of certain surfaces there is a tendency for vibration to develop in the vacuum cleaner as a result of the engagement of the rotary agitator against the particular surface being cleaned. This vibration is often transmitted through the control handle and is often annoying to the user. A need is therefore identified for an upright vacuum cleaner that addresses these problems in a manner to provide enhanced cleaning efficiency as well as vibration reduction.

SUMMARY OF THE INVENTION

In accordance with the purposes of the present invention as described herein, an improved upright vacuum cleaner is provided. That vacuum cleaner includes a nozzle assembly and a canister assembly pivotally mounted to the nozzle assembly. A suction fan and motor are carried on one of the nozzle assembly and the canister assembly. Additionally, the upright vacuum cleaner includes a means, such as a biaser, having a first end engaging the nozzle assembly and a second end engaging the canister assembly. This biaser provides a positive downforce urging a forward end of the nozzle assembly toward the surface to be cleaned. This urging not only enhances cleaning efficiency but also serves to dampen vibration.

In accordance with additional aspects of the present invention, the biaser may be a torsion spring. Further, the nozzle assembly may include a hollow stub shaft received within a cooperating groove in the canister assembly. That stub shaft defines an axis for pivoting movement of the canister assembly with respect to the nozzle assembly as the vacuum cleaner is manipulated by the user. At least a portion of the spring is received in this hollow stub shaft.

Still further, the canister assembly may include a channel adjacent the groove and the second end of the spring is elongated and received in that channel. The channel may be formed, for example, by a box rib on the wall of the canister assembly. Additionally, the hollow stub shaft may include a slot in the side wall thereof through which the end of the spring extends into the channel.

The spring is selected to provide between about 1.2 and about 3.2 lbs/sq. in. of preload and more typically between about 2.0 and about 2.4 lbs/sq. in. of preload. Such a spring provides between about 0.2 and 3.0 lbs/sq. in. of downforce on a forward end of the nozzle assembly. In a typical arrangement, the spring is selected to provide a downforce of between about 0.8 and about 1.6 lbs/sq. in. (e.g. about 1.2 lbs/sq. in.) of downforce on a forward end of the nozzle assembly when the canister assembly is positioned at about a 135° included working angle with respect to the nozzle assembly: that is, when the canister assembly forms an included angle of about 45° with the floor being cleaned.

The resulting downforce reduces the vibration of the nozzle assembly and advantageously increases the cleaning efficiency of the vacuum cleaner by maintaining the nozzle assembly in close engagement with the surface being cleaned. This is a particular advantage as vibration may even be controlled in canister and nozzle assemblies constructed from lighter weight materials. Such materials allow the production of more lightweight vacuum cleaners that are particularly favored by consumers since they are easier to handle and require less muscle effort to use.

The invention also includes a method of increasing the cleaning efficiency of a vacuum cleaner by providing a downforce on the nozzle assembly of the vacuum cleaner to urge the nozzle assembly toward the floor being cleaned.

Still further, the invention also includes a method of reducing vibration in a vacuum cleaner by providing a biasing force between the nozzle assembly and the canister assembly to dampen vibration produced by engagement of the rotary agitator with the surface being cleaned.

In the following description there is shown and described one possible embodiment of this invention, simply by way of illustration of one of the modes best suited to carry out the invention. As it will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention, and together with the description serves to explain the principles of the invention. In the drawing:

FIGS. 3*a*–3*c* are detailed, schematical side elevational views showing the orientation of the spring in the hollow stub shaft with the first end engaging the nozzle assembly and the second end engaging a box rib on the canister assembly when the canister assembly is in fully down, operating and fully upright storage positions; and FIG. 4 is a detailed perspective view showing the receipt of the stub shaft on the nozzle assembly in the cooperating notch on the canister assembly.

Reference will now be made in detail to the present preferred embodiment of the invention, an example of which is illustrated in the accompanying drawing.

DETAILED DESCRIPTION OF THE INVENTION

Figure 1:
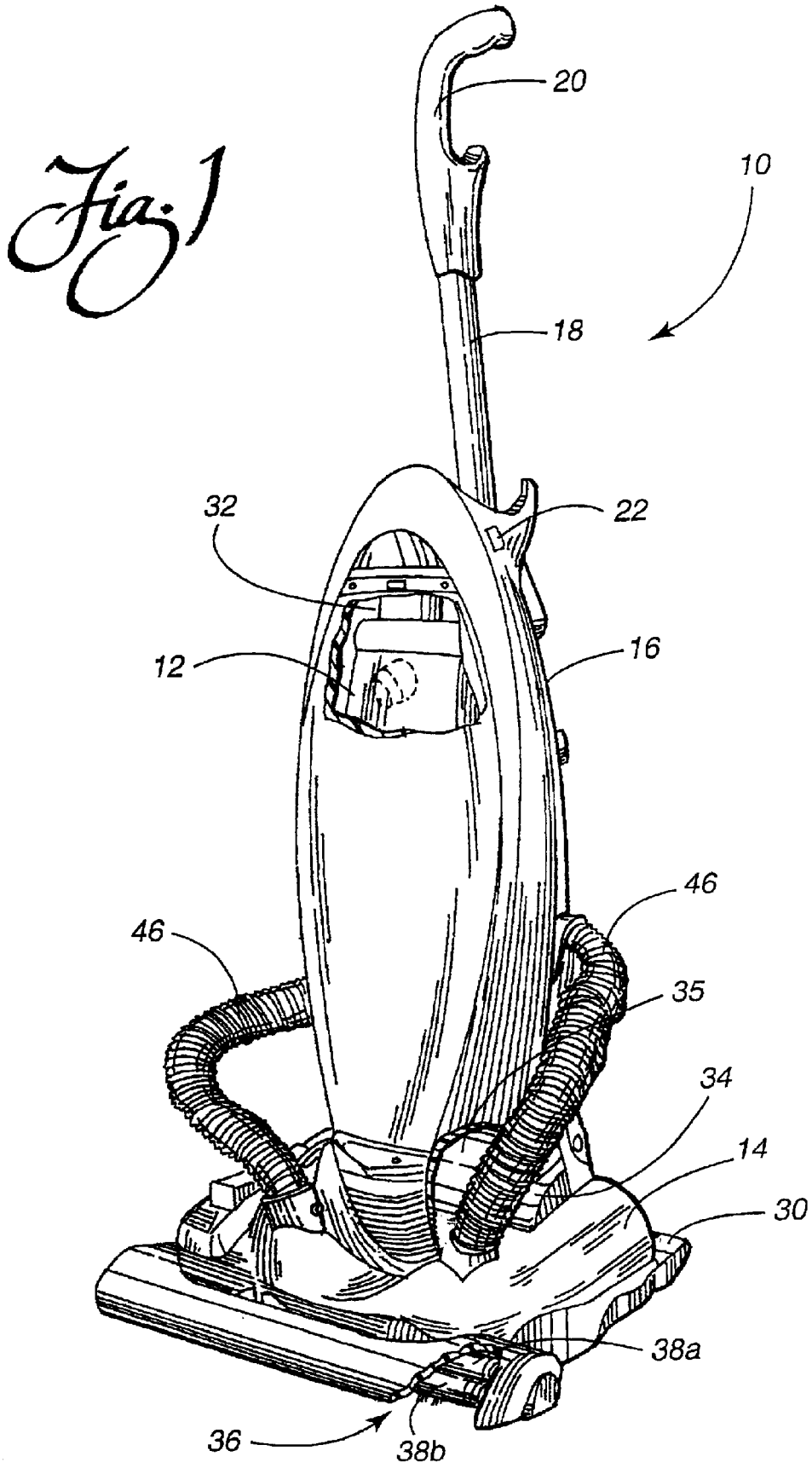
FIG. 1 is a perspective view of an vacuum cleaner constructed in accordance with the teachings of the present invention.

Reference is now made to FIG. 1 showing the upright vacuum cleaner 10 of the present invention. The upright vacuum cleaner 10 includes a nozzle assembly 14 and a canister assembly 16. The canister assembly 16 further includes a control handle 18 and a hand grip 20. A control switch 22 is provided for turning the vacuum cleaner on and off. Of course, electrical power is supplied to the vacuum cleaner 10 from a standard electrical wall outlet through a cord (not shown).

As is known in the art, sets of front and rear wheels (not shown) are provided, respectively, on the nozzle assembly 14 and canister assembly 16 to support the weight of the vacuum cleaner 10. Together, these two sets of wheels allow the vacuum cleaner 10 to roll smoothly across the surface being cleaned. To allow for convenient storage of the vacuum cleaner 10, a foot latch 30 functions to lock the canister assembly 16 in an upright position as shown in FIG. 1. When the foot latch 30 is released, the canister assembly 16 may be pivoted relative to the nozzle assembly 14 as the vacuum cleaner 10 is manipulated back-and-forth to clean the floor.

The canister assembly 16 includes a cavity 32 adapted to receive and hold a dust bag 12. Alternatively, the vacuum cleaner 10 could be equipped with a dust collection cup such as found on cyclonic type models if desired. Additionally, the canister assembly 16 carries a suction fan 34 and suction fan drive motor 35. Together, the suction fan 34 and its cooperating drive motor 35 function to generate a vacuum airstream for drawing dirt and debris from the surface to be cleaned. While the suction fan 34 and suction fan drive motor 35 are illustrated as being carried on the canister assembly 16, it should be appreciated that they could likewise be carried on the nozzle assembly 14 if desired.

The nozzle assembly 14 includes a nozzle and agitator cavity 36 that houses a pair of rotating agitator brushes 38*a*, 38*b*. The agitator brushes 38*a*, 38*b* shown are rotatably driven by the drive motor 35 through a cooperating belt and gear drive (not shown). In the illustrated vacuum cleaner 10, the scrubbing action of the rotary agitator brushes 38*a*, 38*b* and the negative air pressure created by the suction fan 34 and drive motor 35 cooperate to brush and beat dirt and dust from the nap of the carpet being cleaned and then draw the dirt and dust laden air from the agitator cavity 36 to the dust bag 12. Specifically, the dirt and dust laden air passes serially through one of the hoses 46 and an integrally molded conduit in the nozzle assembly 14 and/or canister assembly 16 as is known in the art. Next, it is delivered into the dust bag 12 which serves to trap the suspended dirt, dust and other particles inside while allowing the now clean air to pass freely through to the suction fan 34, a final filtration cartridge (not shown) and ultimately to the environment through the exhaust port (not shown).

Figures 2A, 2B:
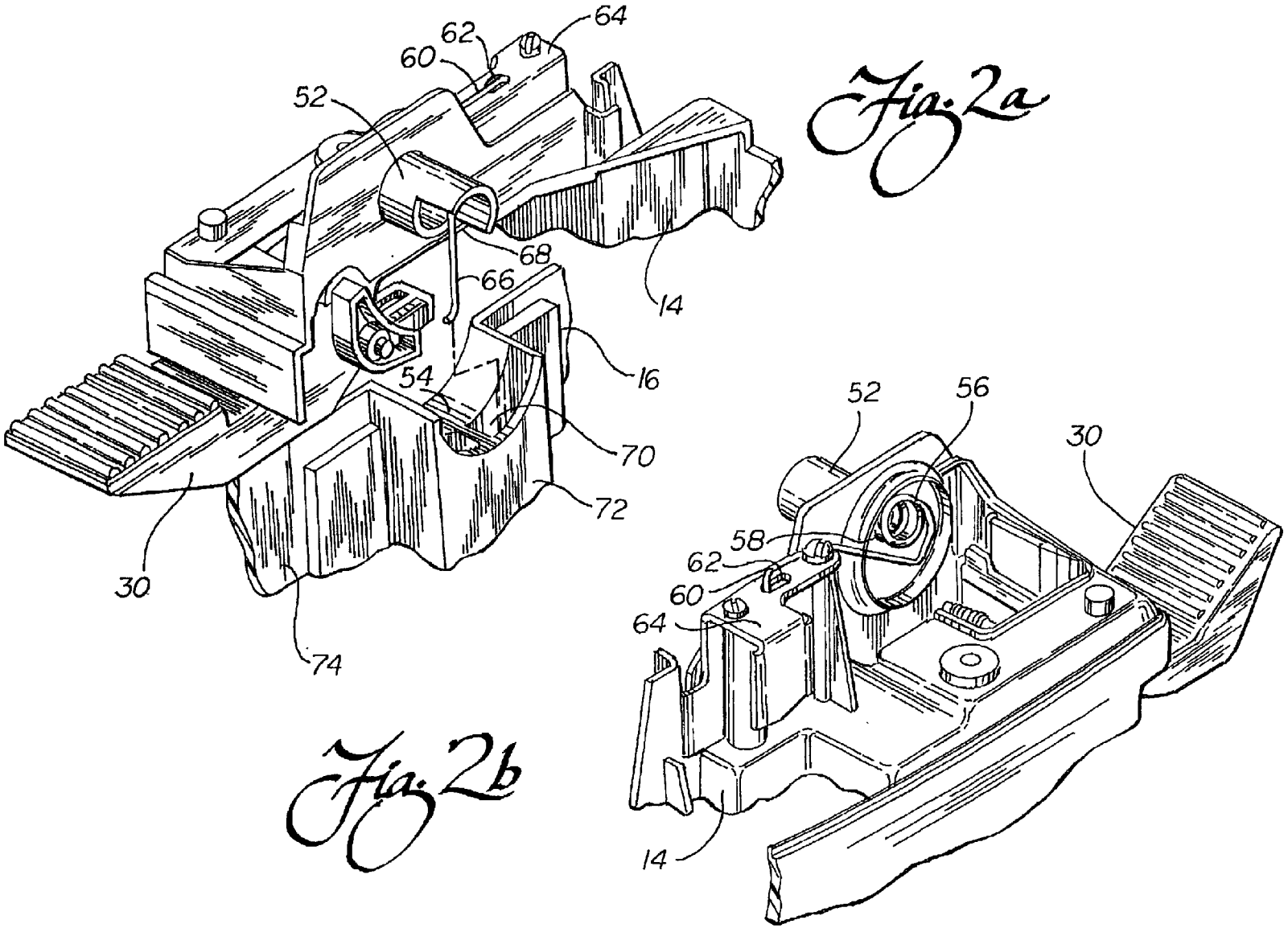
FIGS. 2*a* and 2*b* are detailed perspective views from each side showing the positioning of the spring for providing the desired downforce on the nozzle assembly.
Figure 7:
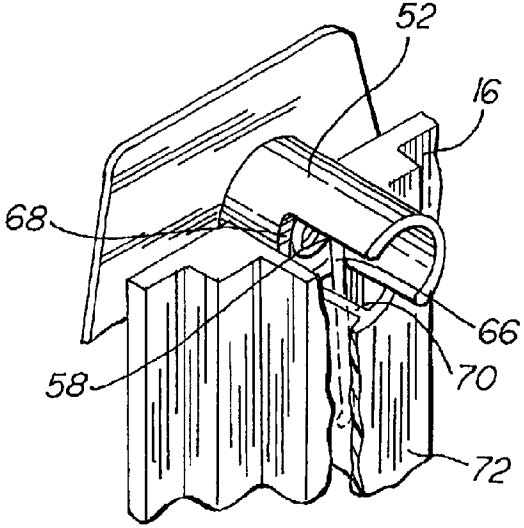
Figure 7A:
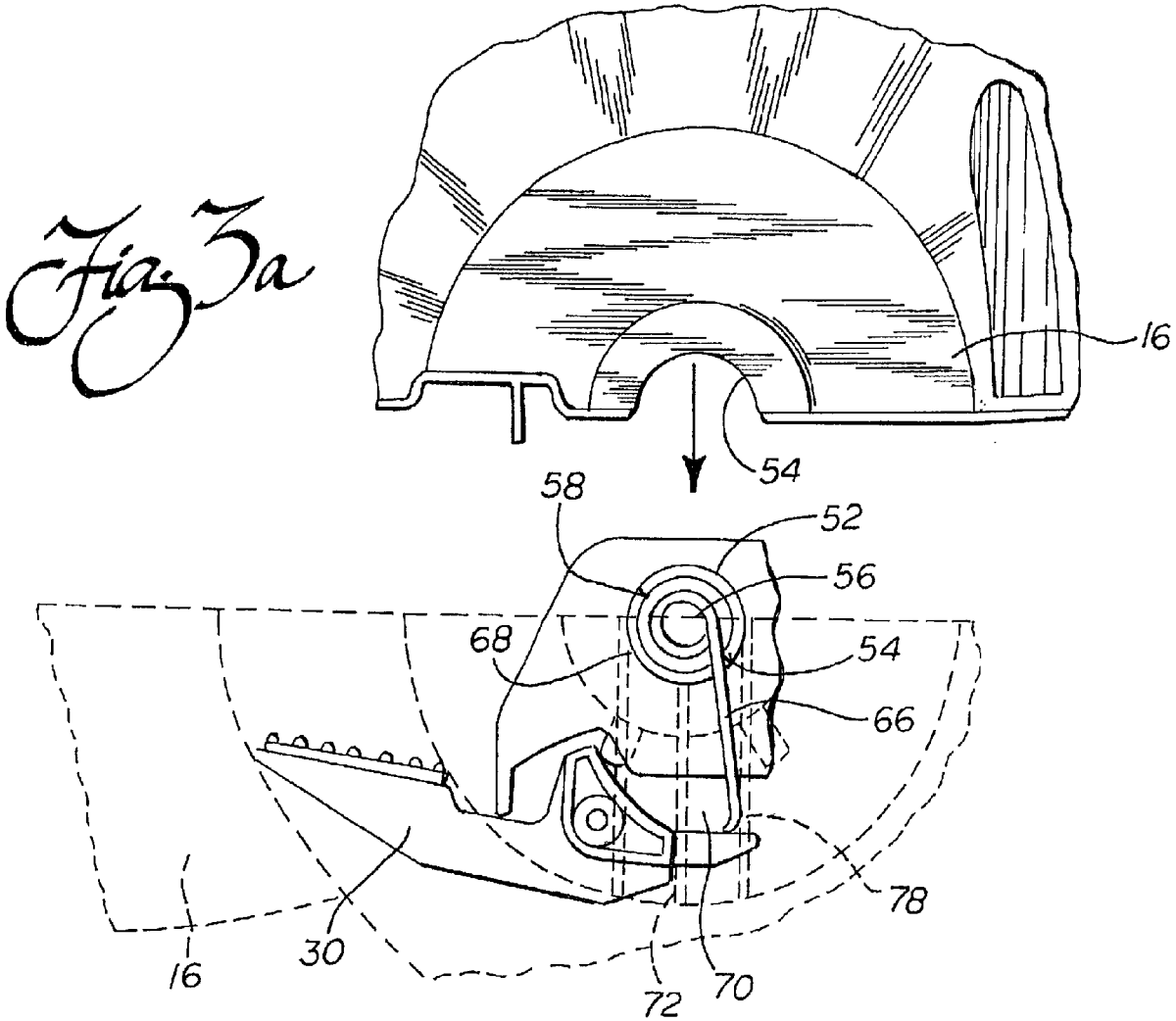
Figure 3C:
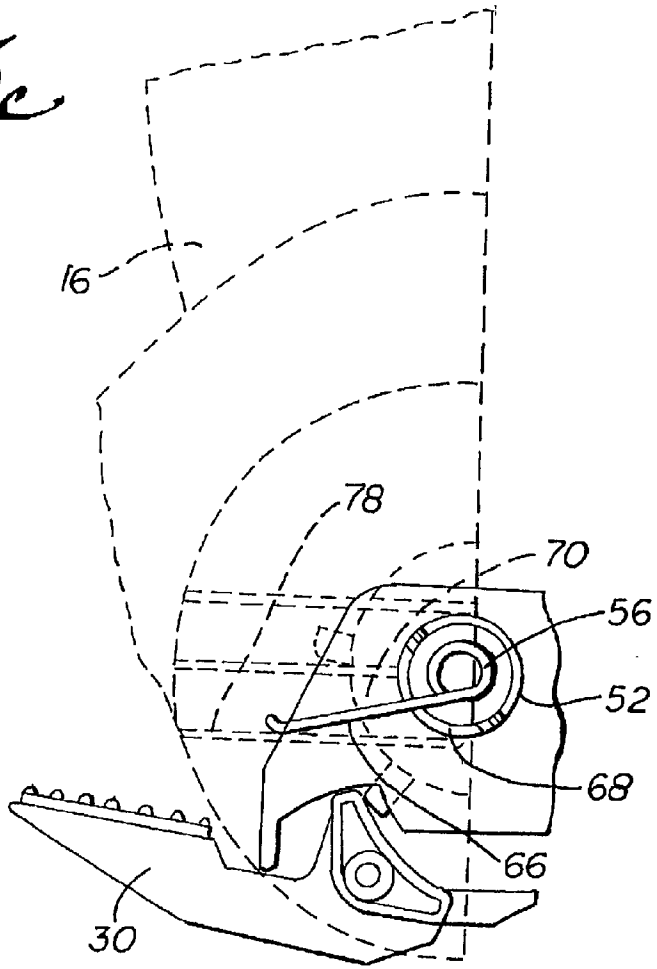
Figure 3B:
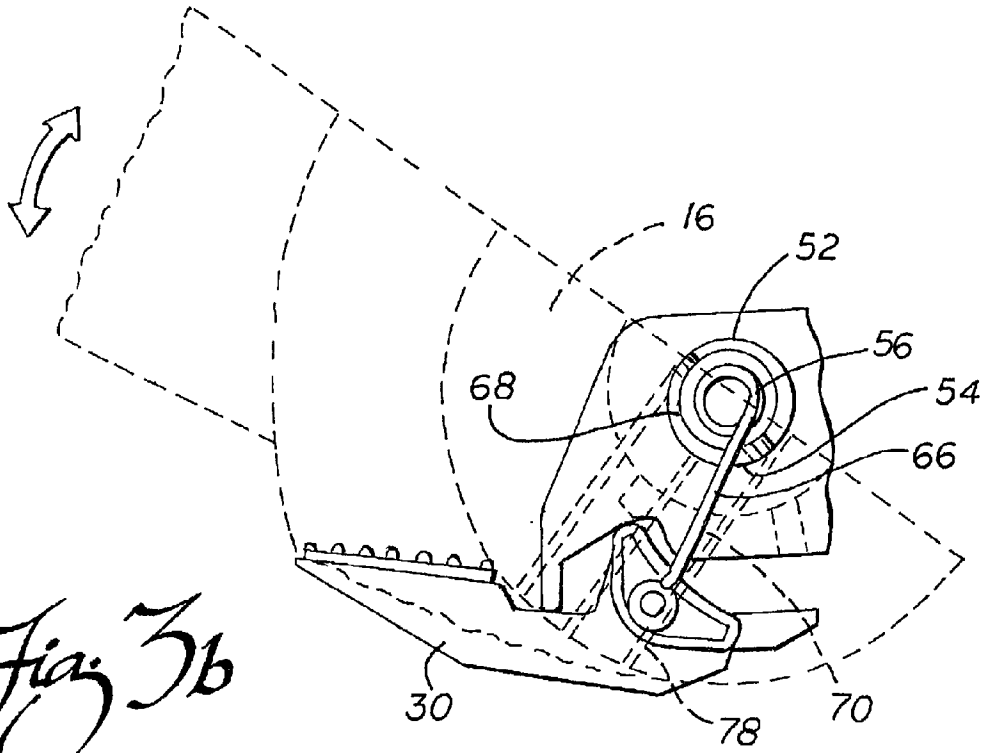

As best shown in FIGS. 2*a* and 2*b*, the nozzle assembly 14 includes a hollow stub shaft 52 at one side thereof. This stub shaft 52 is received and nests in a cooperating groove 54 provided in the canister assembly 16. For clarity of illustration both portions of the canister assembly 16 are shown in FIG. 3*a*. Only the rear portion is shown in FIGS. 3*b*, 3*c* and 4. The two portions of the canister assembly 16 mate along the centerline of the groove 54 to aid in the overall assembly of the vacuum cleaner 10. While not shown, it should be appreciated that a similar structural configuration may be provided on the other side of the vacuum cleaner 10 to provide the same function. The two stub shafts are aligned to provide a single axis about which the nozzle assembly 14 pivots relative to the canister assembly 16 during vacuum cleaner operation.

As further illustrated, a biaser, in the form of a torsion spring 56, is partially received in the stub shaft 52. More specifically, the coiled portion 58 of the spring 56 is positioned in the stub shaft 52. A first end 60 of the spring is received in an aperture 62 in the metal reinforcing plate 64 of the nozzle assembly 14. A second end 66 of the spring 56 extends through a slot 68 in the wall of the stub shaft 52 downwardly into a channel 70 formed by a box rib 72 on the wall 74 of the canister assembly 16. When the canister assembly 16 is in the full down position (see FIG. 3*a*) forming an included angle with the nozzle assembly 14 of approximately 170°–178°, the second end 66 of the spring 56 projects downwardly just inside the forward edge 76 of the groove 68 and provides the necessary spring force to urge the nozzle assembly downwardly into engagement with the surface being cleaned.

As the control handle 18 and canister assembly 16 are pivoted upwardly to an included working angle of approximately 135° with the nozzle assembly 14, (i.e. into an angular orientation commonly employed during use of the vacuum cleaner by the operator) shown in FIG. 3*b*, the forward wall 78 of the box rib 72 partially winds the torsion spring 56. This further increases the downforce on the forward end of the nozzle assembly 14 so as to better insure that the nozzle assembly 14 stays down in engagement with the ground as the vacuum cleaner is moved back-and-forth by means of the handle.

As the handle 18 and canister assembly 16 are pivoted still further with respect to the nozzle assembly 14 toward the upright position, further winding of the torsion spring 56 occurs (see FIG. 3*c*). It should be appreciated that the slot 68 cut in the stub shaft 52 provides sufficient clearance to allow free passage of the end 66 of the spring 56 into the channel 70 in all the various angular orientations that the canister assembly 16 may assume with the nozzle assembly 14. Thus the spring 56 provides in all operating positions between about 1.2 and about 3.2 and more typically between about 2.0 and about 2.4 lbs/sq. in. of preload. This converts to between about 0.2 and 3.0 lbs/sq. in. of downforce on the forward end of the nozzle assembly 14. Thus, when the canister assembly 16 is positioned at about a 135° working angle with the nozzle assembly 14 (see FIG. 3*b*), the spring may provide a downforce of between about 0.8 and about 1.6 lbs/sq. in. and more typically about 1.2 lbs/sq. in. on the forward end of the nozzle assembly 14. These specific ranges are, of course, only mentioned to be illustrative of the invention and are not to be considered restrictive.

Numerous benefits result from employing the concepts of the present invention. The downforce the spring 56 exerts on the nozzle assembly 14 serves a dual function. First, it resists any tendency of the nozzle assembly 14 to be lifted from the floor being cleaned as the vacuum cleaner 10 is manipulated or pushed and pulled back-and-forth by the operator. As a consequence, the agitators 38*a* and 38*b* are better maintained in contact with the floor. This promotes more efficient and effective cleaning. Second, it has a tendency to dampen any vibration resulting from the engagement of the agitators 38*a*, 38*b* or the brushes, beater bars or other cleaning structures carried thereon with the surface being cleaned. This advantageously reduces or eliminates this operator annoyance which may otherwise become very pronounced when the vacuum cleaner is operated on surfaces having particular physical characteristics. Further, it should be appreciated that these benefits are also provided and are even more pronounced when the vacuum cleaner is constructed from lightweight materials. Such vacuum cleaners are user friendly since they are easier and more convenient to move and manipulate.

The foregoing description of the preferred embodiment of the invention has been presented for purposes of illustration and description. It is not intended to be exhaustive or to limit the invention to the precise form disclosed. Obvious modifications or variations are possible in light of the above teachings. For example, while a vacuum cleaner with dual agitators is illustrated, the invention is equally applicable to a vacuum cleaner with one agitator or more than two agitators. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. An upright vacuum cleaner, comprising:

a nozzle assembly;

a canister assembly pivotally mounted to said nozzle assembly;

a suction fan and motor carried on one of said nozzle assembly and said canister assembly; and a biaser having a first end engaging said nozzle assembly and a second end engaging said canister assembly so as to provide a positive downforce urging a forward end of said nozzle assembly toward a surface to be cleaned.

2. The upright vacuum cleaner of claim 1, wherein said biaser is a spring.

3. The upright vacuum cleaner of claim 1, wherein said biaser is a torsion spring.

4. The upright vacuum cleaner of claim 1, wherein said nozzle assembly includes a hollow stub shaft received within a groove in said canister assembly, said stub shaft cooperating with said groove to define an axis for pivoting movement of said canister assembly with respect to said nozzle assembly.

5. The upright vacuum cleaner of claim 4, wherein at least a portion of said spring is received in said hollow stub shaft.

6. The upright vacuum cleaner of claim 5, wherein said canister assembly includes a channel adjacent said groove and said second end of said spring is elongated and is received in said channel.

7. The upright vacuum cleaner of claim 6, wherein said channel is formed by a box rib on a wall of said canister assembly.

8. The upright vacuum cleaner of claim 6, wherein said hollow stub shaft includes a slot through which said second end extends into said channel.

9. The upright vacuum cleaner of claim 1, wherein said biaser provides between about 1.2 and about 3.2 lbs/sq. in. of preload.

10. The upright vacuum cleaner of claim 1, wherein said biaser provides between about 2.0 and about 2.4 lbs/sq. in. of preload.

11. The upright vacuum cleaner of claim 1, wherein said biaser provides between about 0.2 and 3.0 lbs/sq. in. of downforce on a forward end of said nozzle assembly.

12. The upright vacuum cleaner of claim 1, wherein said biaser provides a downforce of between about 0.8 and about 1.6 lbs/sq. in. on a forward end of said nozzle assembly when said canister assembly is positioned at about a 135° included working angle with respect to said nozzle assembly.

13. The upright vacuum cleaner of claim 1, wherein said biaser provides a downforce of about 1.2 lbs/sq. in. on a forward end of said nozzle assembly when said canister assembly is positioned at about a 135° included working angle with respect to said nozzle assembly.

14. An upright vacuum cleaner, comprising:

a nozzle assembly;

a canister assembly pivotally mounted to said nozzle assembly;

a suction fan and motor carried on one of said nozzle assembly and said canister assembly; and means for biasing a forward end of said nozzle assembly toward a surface to be cleaned wherein said biasing means is a torsion spring.

15. The upright vacuum cleaner of claim 14, wherein said nozzle assembly includes a hollow stub shaft received within a groove in said canister assembly, said stub shaft cooperating with said groove to define an axis for pivoting movement of said canister assembly with respect to said nozzle assembly.

16. The upright vacuum cleaner of claim 15, wherein at least a portion of said torsion spring is received in said hollow stub shaft.

17. The upright vacuum cleaner of claim 16, wherein said canister assembly includes a channel adjacent said groove and an end of said spring is elongated and is received in said channel.

18. The upright vacuum cleaner of claim 17, wherein said channel is formed by a box rib on a wall of said canister assembly.

19. The upright vacuum cleaner of claim 17, wherein said hollow stub shaft includes a slot through which said end extends into said channel.

20. An upright vacuum cleaner, comprising:

a nozzle assembly;

a canister assembly pivotally mounted to said nozzle assembly;

a suction fan and motor carried on one of said nozzle assembly and said canister assembly; and means for biasing a forward end of said nozzle assembly toward a surface to be cleaned wherein said biasing means provides between about 1.2 and about 3.2 lbs/sq. in. of preload.

21. An upright vacuum cleaner, comprising:

a nozzle assembly;

a canister assembly pivotally mounted to said nozzle assembly;

a suction fan and motor carried on one of said nozzle assembly and said canister assembly; and means for biasing a forward end of said nozzle assembly toward a surface to be cleaned wherein said biasing means provides between about 2.0 and about 2.4 lbs/sq. in. of preload.

22. An upright vacuum cleaner, comprising:

a nozzle assembly;

a canister assembly pivotally mounted to said nozzle assembly;

a suction fan and motor carried on one of said nozzle assembly and said canister assembly; and means for biasing a forward end of said nozzle assembly toward a surface to be cleaned wherein said biasing means provides between about 0.2 and 3.0 lbs/sq. in. of downforce on a forward end of said nozzle assembly.

23. An upright vacuum cleaner, comprising:

a nozzle assembly;

a canister assembly pivotally mounted to said nozzle assembly;

a suction fan and motor carried on one of said nozzle assembly and said canister assembly; and means for biasing a forward end of said nozzle assembly toward a surface to be cleaned wherein said biasing means provides a downforce of between about 0.8 and about 1.6 lbs/sq. in. on a forward end of said nozzle assembly when said canister assembly is positioned at about a 135° included working angle with respect to said nozzle assembly.

24. An upright vacuum cleaner, comprising:

a nozzle assembly;

a canister assembly pivotally mounted to said nozzle assembly;

a suction fan and motor carried on one of said nozzle assembly and said canister assembly; and means for biasing a forward end of said nozzle assembly toward a surface to be cleaned wherein said biasing means provides a downforce of about 1.2 lbs/sq. in. on a forward end of said nozzle assembly when said canister assembly is positioned at about a 135° included working angle with respect to said nozzle assembly.

* * * * *